US005104105A

United States Patent [19]

Cote et al.

[11] Patent Number: 5,104,105

[45] Date of Patent: Apr. 14, 1992

[54] METHOD AND APPARATUS FOR PROVIDING IDENTIFYING INDICIA FOR MOVING BUNDLES AND THE LIKE

[75] Inventors: Kevin Cote, Ft. Lauderdale; Jeremy Hyne, Cooper City, both of Fla.

[73] Assignee: Quipp Systems, Inc., Miami, Fla.

[21] Appl. No.: 537,582

[22] Filed: Jun. 14, 1990

[51] Int. Cl.[5] ..... B41F 13/54

[52] U.S. Cl. ..... 270/1.1; 270/54; 270/58; 271/200; 414/795.5; 414/789.5

[58] Field of Search ..... 270/1.1, 21.1, 52, 53, 270/54, 55, 57, 58; 271/200, 201; 414/794.5, 795.5, 789.5

[56] References Cited

U.S. PATENT DOCUMENTS

| | | | |
|---|---|---|---|
| 3,525,444 | 8/1970 | Brockmuller | 414/794.5 |
| 3,608,888 | 9/1971 | McCain | 270/54 |
| 3,897,492 | 6/1975 | Watson | 270/58 |
| 3,917,252 | 11/1975 | Harder | 270/58 |
| 3,923,145 | 12/1975 | Muller | 270/58 |
| 4,033,807 | 7/1977 | Neill | 270/58 |
| 4,132,313 | 1/1979 | Kolosov | 270/58 |
| 4,279,555 | 7/1981 | Rydell | 414/794.5 |

*Primary Examiner*—Edward K. Look
*Assistant Examiner*—Therese M. Newholm
*Attorney, Agent, or Firm*—Louis Weinstein

[57] ABSTRACT

A sheet is moved into a tray. The height of a bundle is determined as it moves along a conveyor. A belt drive is activated to pinch the delivered sheet and advance it to a swingable applicator whose outfeed end is movable to a position just above the top of the bundle. Information is printed upon the sheet prior to entering the applicator assembly. The sheet is advanced through the applicator assembly at a speed synchronized with bundle speed. The applicator lays the sheet upon the bundle which is then moved to a wrapper. The outlet end of the applicator assembly is moved so that it is positioned just above the bundle receiving the sheet under control of a height sensor. The timing of sheet delivery is a function of bundle speed and bundle height. A microprocessor responsive to a detector sensing the feeding of the sheet to the applicator assembly and responsive to bundle height controls the initiation of advancement of the sheet from the tray. An AC synchronous motor drives the applicator asembly to the desired outfeed height and an encoder detects the height of the applicator outfeed end for feedback control. Preprinting of additional data may be provided off-line and such data may be read prior to insertion of the preprinted sheet into the receiving tray to control the formation of bundles. In order to synchronize the mating of the preprinted sheet with the desired bundle, the sheets containing data relating to such bundles may be temporarily stored through the use of a queuing roller assembly.

39 Claims, 4 Drawing Sheets

METHOD AND APPARATUS FOR PROVIDING IDENTIFYING INDICIA FOR MOVING BUNDLES AND THE LIKE

FIELD OF THE INVENTION

The present invention relates to identifying bundles and more particularly to a novel method and apparatus for identifying bundles by means of printing upon a sheet which is delivered to the top of moving bundles wherein the bundles may be of a variable height, the printing and application of the identifying sheet being performed while the bundles (and the sheet) are moving.

BACKGROUND OF THE INVENTION

Signatures, such as, for example, newspapers are produced at relatively high speeds, typically of the order of 80,000 to 90,000 signatures per hour. The signatures are then divided into bundles of predetermined count. It is further highly desirable to identify each bundle as to source, destination, count, as well as other types of identifying indicia including, for example, bar codes.

A variety of techniques exist for printing identifying information upon a sheet and then delivering the sheet to a stationary bundle. This technique, which requires that the bundle be stationary preparatory to receipt of the information sheet, significantly complicates and degrades high speed handling of bundles.

BRIEF DESCRIPTION OF THE INVENTION

The present invention is characterized by comprising method and apparatus for printing on sheets "on the fly" and for mating each printed sheet with its associated bundle. Alternatively, the present invention is characterized by comprising a method and apparatus for mating a preprinted sheet with a moving bundle and further for reading preprinted data, preparing a bundle in accordance with preprinted data read from said sheet and mating the sheet with a moving bundle either with or without the provision of additional printed matter.

The present invention comprises a tray for receiving a sheet from any suitable delivery means, the sheet being introduced into a slot. The forward end of the sheet inserted into the tray is positioned within a V-shaped entrance throat portion of a pair of copending drive belt assemblies.

A pair of pinch rollers mounted at the free ends of a pair of swingably mounted pinch roller drive arms are urged together, forming a nip which "grabs" the forward end of the sheet in the tray and feeds the sheet between cooperating belts into the receiving end of a sheet applicator assembly. A printer which may, for example, be an ink jet printer, prints desired indicia upon the sheet at a location upstream relative to the inlet end of the applicator assembly.

The applicator assembly comprises a pair of swingable applicator arms each having continuously moving drive belt assemblies cooperating with one another to advance a sheet entering into the inlet end of the applicator arms toward the outlet end of the-applicator assembly which is provided with nose rollers about which the applicator assembly drive belts are entrained. The applicator arms are swingably mounted at their inlet ends upon suitable pivot shafts. Drive means coupled to the shaft of the lower applicator arm assembly is designed to accurately position the lower applicator arm at a desired angle in order to place the nose of the lower applicator arm immediately above the bundle to receive the sheet being advanced through the applicator assembly. The upper applicator arm rests upon and hence follows the lower applicator arm and is further biased toward the lower applicator arm by suitable resilient bias means coupled between the upper and lower applicator arms.

Suitable sensor means such as, for example, ultrasonic sensor means determines the height of each passing bundle being advanced toward the sheet applicator station. Light sensor means senses the passing of the next bundle to receive a sheet. This information is utilized by microprocessor-based control means for accurately positioning the nose of the applicator assembly and for timing the acceleration of each sheet to assure its delivery to the proper bundle. The outlet speed of the applicator assembly is synchronized with bundle speed assuring that each sheet is maintained in position upon its associated bundle preparatory to being wrapped.

The angular position of the applicator assembly is controlled by a motor control means to adjust the height of the applicator assembly outlet end to place the sheet to be delivered immediately above its associated bundle. Encoder means are provided to assure the proper orientation of the applicator arms, which encoder means may form part of a feedback control means.

The paper sheets may be delivered from a stack of accordion-pleated computer-type paper which is advanced from the top of the stack of sheets, typically through tractor drive means into a burster assembly which separates each sheet and advances the sheets one at a time into the tray of the printer/sheet applicator system. Reader means may be provided, typically between the stack of sheets and the tractor drive assembly to read data derived from a passing sheet and transferring the data to a stacker, for example, to create a signature bundle of a predetermined size. If desired, the sheet may be printed upon to provide additional information related to the bundle as the sheet passes the printer arranged within the printer/sheet applicator system.

In the event that it is desired to control the arrival of information to a stacker, a queuing roller assembly may be provided between the reader for reading preprinted sheets and the printer/sheet applicator in order to temporarily store sheets and thereby enable the stacker to execute a control and deliver the desired bundle to the sheet applicator location in synchronism with the sheet associated with such bundle.

OBJECTS OF THE INVENTION

It is, therefore, one object of the present invention to provide a novel method and apparatus for applying information to bundles while the bundles are in motion.

Still another object of the present invention is to apply information used to identify a particular bundle upon a sheet and for merging the sheet with its associated bundle while the bundle is moving along a conveyor path.

Still another object of the present invention is to provide a novel method and apparatus for applying information to a bundle including inserting sheets one at a time into an input tray; sensing the position and the height of a bundle; accelerating the sheet at a time controlled by bundle height and position; and feeding the sheet through an applicator assembly to advance the sheet to the bundle so that the sheet and its associated bundle are moving at substantially the same velocity when merged; and including sensing the height of the bundle and adjusting the height of the sheet applicator assembly responsive to bundle height to locate the applicator assembly outlet end immediately above the associated bundle; and further including printing information upon the sheet preparatory to the sheet passing through the applicator assembly outlet.

Another object of the present invention is to provide a novel method and apparatus for affixing data to a bundle of any height including the steps of providing a preprinted sheet; reading the data on the sheet; controlling a stacker to form a bundle of a predetermined size and/or height according to the preprinted information; delivering the sheet to an applicator; and applying the sheet to the bundle as the bundle passes beneath the applicator outlet station.

Still another object of the present invention is to provide a novel method and apparatus for synchronizing the delivery of a sheet containing indicia associated with a particular bundle comprising the steps of: detecting the location of a bundle relative to the applicator and accelerating and advancing a sheet to the applicator outlet end responsive to the velocity and height of the associated bundle.

Still another object of the present invention is to provide a novel applicator assembly for applying information to a bundle or the like comprising an input tray for receiving a sheet; an applicator assembly which is adjustable to deliver a sheet to the top of a bundle of any height; drive belts for grabbing a sheet from the input tray and delivering the sheet to the applicator assembly whereby the grabbing of the sheet is initiated according to the position, velocity and height of the bundle as well as the orientation of the applicator assembly, the applicator assembly being automatically positioned so that its movable output end lies immediately above the bundle to receive the sheet passing through the applicator assembly responsive to bundle height sensing means and further comprising a printer for printing data upon a sheet preparatory to its entry into the applicator assembly.

The above, as well as other objects of the present invention, will become apparent when reading the accompanying description and drawings, in which:

DETAILED DESCRIPTION OF THE PREFERRED EMBODIMENTS

Figures 1A, 1B, 1C:
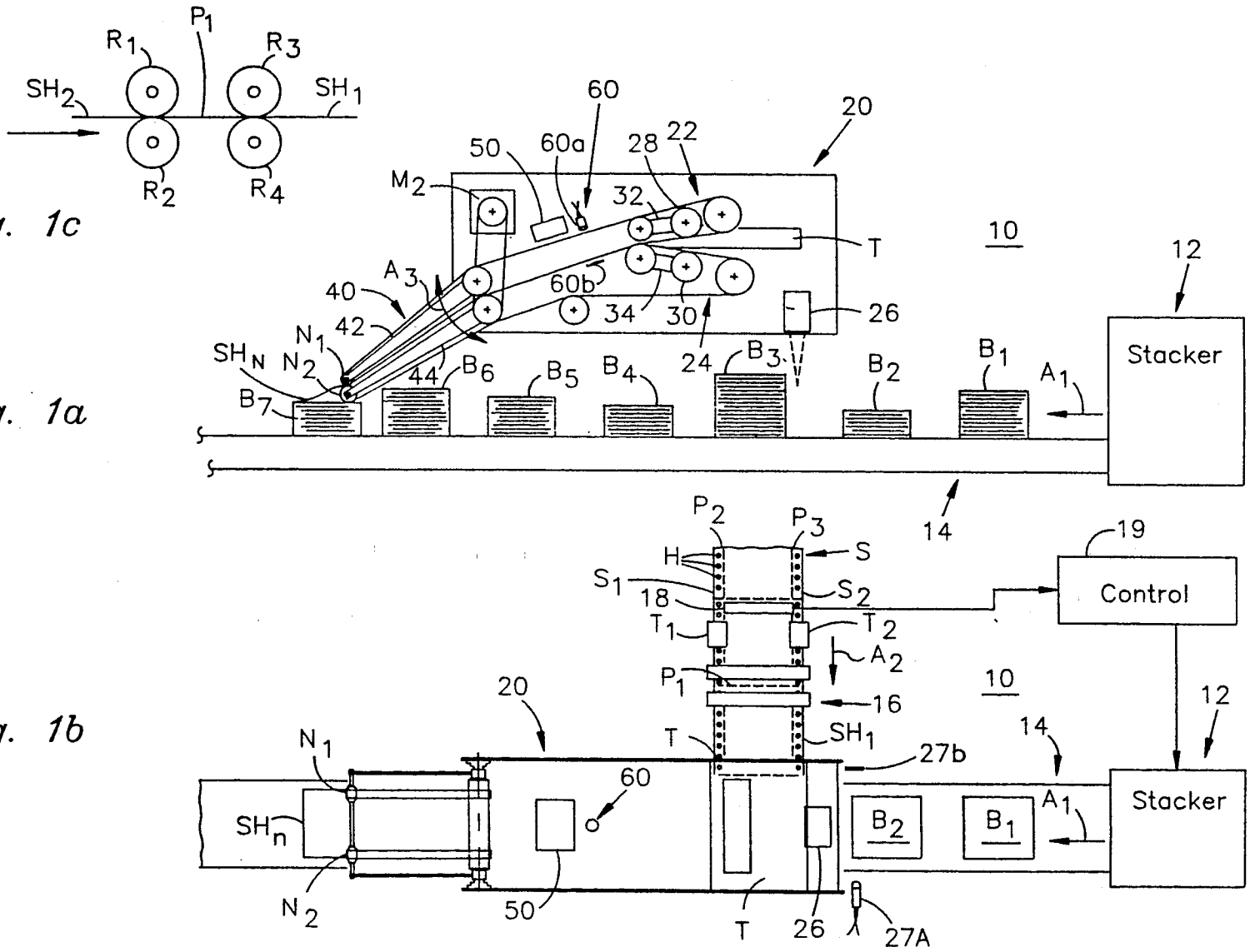
FIG. 1*a* is an elevational view of a system embodying the printer/sheet applicator apparatus of the present invention.
FIG. 1*b* is a plan view of the system of FIG. 1*a;*
FIG. 1*c* is an end view of the burster assembly shown in FIG. 1*b;*

FIGS. 1*a* and 1*b* show elevational and plan views, respectively of a system 10 for forming bundles and for merging information bearing sheets with the bundles. A stacker 12 which may be of any suitable type, forms bundles of signatures delivered to the stacker from a press typically delivering signatures to the stacker at speeds of 80,000 newspapers per hour. It should be understood that the present invention may be utilized to affix data to bundles utilizing a press having greater or smaller delivery speeds. Obviously, stacker 12 is chosen so that its capabilities are compatible with the press delivering signatures thereto. Some suitable stackers which may be utilized for this purpose are described, for example, in copending U.S. appln. Ser. Nos. 409,520, filed Sept. 19, 1989 and 397,584, filed Aug. 23, 1989. The stacker example given herein is merely exemplary and any stacker capable of forming signature bundles of variable height may be utilized.

Present day stackers are capable of being programmed or otherwise controlled to form bundles of newspapers having a wide range of heights. For example, bundles may contain as few as ten or fifteen signatures and as many as a hundred signatures or more. The bundles formed may be of the compensated or uncompensated type although the present invention may be employed with stackers forming bundles of any of the above-mentioned types.

As each bundle is completed, it is moved onto a conveyor assembly 14 which conveys signatures to the left along the conveyor assembly as they leave stacker 12 as shown by arrow A1. Each bundle may be of a different height. For example, bundle B1 is taller than bundle B2, while bundle B3 is taller than bundle B1, and so forth. FIG. 1*a* shows seven typical bundles B1–B7 which have been formed by stacker 12 and conveyed along conveyor assembly 14 which may be a belt conveyor assembly, roller conveyor assembly, or any other type of conveying means for conveying the bundles to an applicator station and subsequently to a wrapping station, not shown for purposes of simplicity.

Printer/sheet applicator system 20 of the present invention comprises an input tray T for receiving individual sheets. As shown in FIG. 1*b*, the sheets may be derived from a stack S of accordion-pleated sheets of the computer-type paper typically used with present day computers and being comprised of an elongated web of indeterminate length and having perforations P1 extending across the paper and perforations P2 and P3 may or may not be arranged inwardly from and parallel to the longitudinal sides of the elongated web typically enabling the side portions S1 and S2 bearing the feed holes H to be torn away from the sheet. In the preferred embodiment, the longitudinal perforations are omitted.

The elongated web of accordion-pleated paper is advanced by tractor assemblies T1 and T2 which assemblies are well known in the art and are provided with "treads" having pins which extend into the feed holes H. The treads are continuously moved to advance the web in the direction shown by arrow A2. The continuous web is fed into a burster assembly 16 which, as shown in FIG. 1*c*, is comprised of a first pair of rollers R1, R2 and a second pair of rollers R3, R4. Initially, both pairs of rollers are rotating at a substantially constant velocity. When the sheet separating perforation P1 moves between the pairs of rollers, rollers R1 and R2 are halted while rollers R3 and R4 continue to rotate, causing the forward sheet SH1 to be separated along perforation P1 from the following sheet SH2. The sheet separator may, for example, be a Forms Burster Model 4005 manufactured by Uarco.

Although FIG. 1*b* shows the sheets being fed into the printer/sheet applicator 20 along the upper side relative to FIG. 1*b*, the tray of system 20 is provided with openings on both sides thereof and thus may receive sheets from either side.

The separated sheet SH1 is advanced into tray T where its left-hand edge is positioned within the V-shaped entrance throat portion of first and second sets 22 and 24 of cooperating belts. The height of the bundle to be identified by the sheet SH1 being introduced into tray T is determined by sensor 26 which may, for example, be an ultrasonic-type sensor, such as, for example, the Model PLE Sensor manufactured by Agastat. Alternatively, the sensor may be in the form of a "light curtain" typically comprised of light sources along one side of the conveyor 14 and light sensitive elements along the opposite side of the conveyor wherein the particular number of light beams broken (or unbroken) by the passing bundle determines the height thereof.

Sensor/light source 27*a* (see FIG. 1*b*) cooperates with reflector 27*b* to detect the passing of the leading edge of a bundle. This information, together with bundle height, controls the moment when a sheet in tray T is "grabbed" and controls positioning of the applicator arms.

A pair of pinch rollers 28, 30 are mounted upon operating levers 32, 34 and are moved together to cause the left-hand edge of sheet SH1 to be "pinched" between the upper and lower belt assemblies 22, 24 to advance the sheet to an applicator assembly 40 which is adjustably swingable about a pair of mounting shafts in a counterclockwise or clockwise direction shown by double-headed arrow A3 in order to locate its nose pulleys N1, N2 immediately above the bundle which is intended to be mated with an indicia bearing sheet SHn. The angular orientation of the applicator assembly 40 is controlled by a motor M2 which may, for example, be an AC synchronous motor. Encoder means, which will be more fully described hereinbelow, are provided to detect the angular position of the applicator assembly. The encoder may form part of a feedback control.

The applicator assembly is provided with upper and lower belt assemblies 42, 44 which move the sheet sandwiched therebetween through the applicator assembly to dispense the sheet from the outlet end onto the moving bundle B7, for example. The velocity of the sheet SHn moving through the applicator assembly is substantially the same as the velocity of the bundle B7 moving along conveyor 14. A wrapping or strapping assembly, not shown for purposes of simplicity, is preferably located downstream relative to the printer/sheet applicator system 20 in order to wrap or tie each bundle and further to affix each indicia bearing sheet to its associated bundle.

Each indicia bearing sheet may be printed upon by a printer 50 which is located upstream relative to the applicator assembly 40. Printer 50 is capable of printing as the sheets move past the printer on the fly and may, for example, be a non-impact printer of the ink jet type. For example, one preferred embodiment may be the ink jet printer of the Maxum Single Module type manufactured by Video Jet.

A sensor assembly 60 comprising a combination light source/sensor 60*a* and a reflective strip 60*b* detects the passage of the leading edge of a sheet moving between the belt assemblies 22 and 24 to initiate operation of printer 15 after a delay determined by the spacing between the sensor 60 and printer 50.

As another alternative to the arrangement shown in FIGS. 1*a*–1*c*, the sheets in stack S, shown in FIG. 1*b*, may be preprinted with certain indicia. A reader 18 is provided to read the indicia preprinted upon each sheet as it moves from the tractor assemblies toward the burster 16. This indicia is delivered to a control means 19 which is preferably a microprocessor-based control means for controlling stacker 12 to form a predetermined size or type of bundle and deliver each such bundle to conveyor 14 and further to control the timing of the system to assure that the bundle and its associated sheet reach the sheet applicator station in substantial synchronism.

Figure 1D:
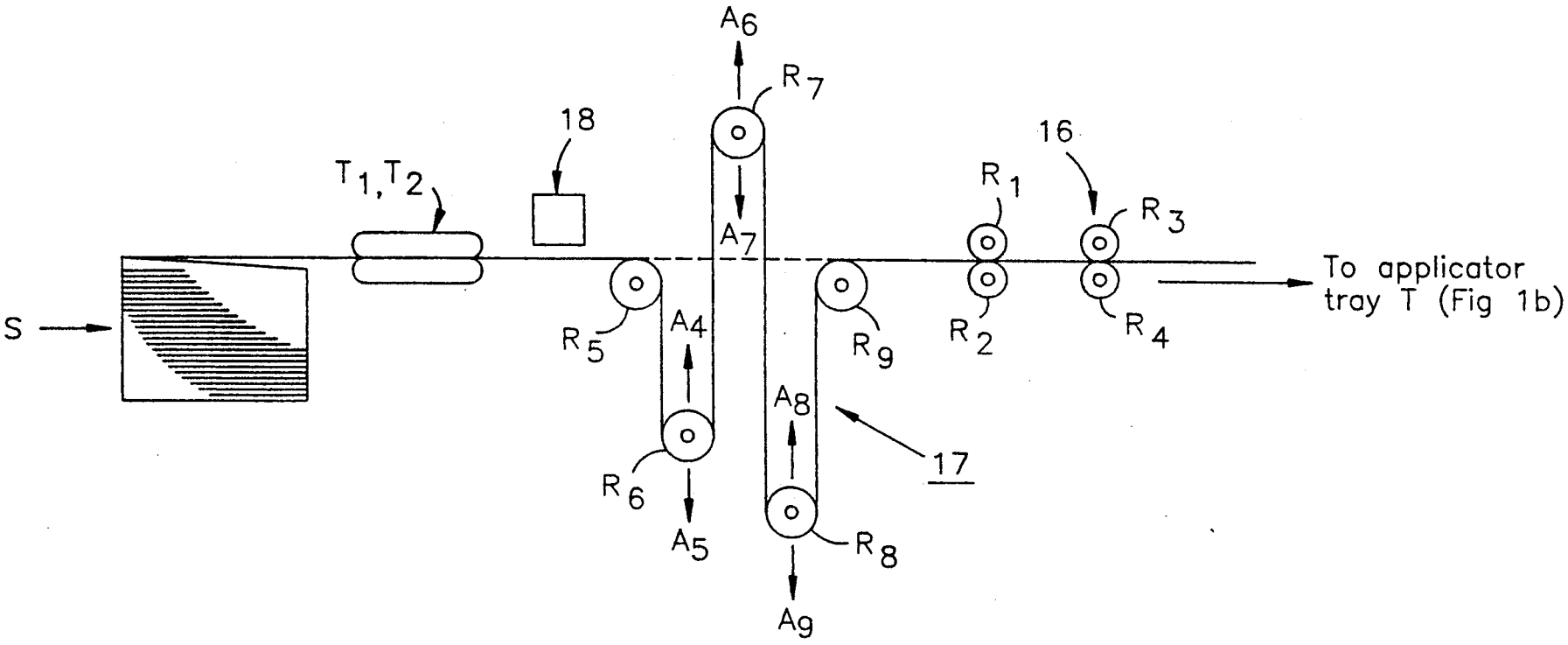
FIG. 1*d* is a plan view of another embodiment for the sheet feeding assembly shown in FIG. 1*b;*

In the event that a number of bundle operations are required, a temporary sheet storage means may be employed as shown in FIG. 1*d* wherein like elements are designated by like numerals as noted, for example, in FIGS. 1*b*, 1*c* and 1*d*.

The elongated, perforated web arranged in an accordion-pleated stack S is advanced through the tractor assemblies T1, T2 past reader 18. A series of rollers R5 through R9 are provided for storing a variable number of sheets before the sheets reach the burster 16. Although rollers R5 and R9 are fixed, i.e. are not linearly movable, rollers R6, R7 and R8, in addition to being rotatable about their central axes are linearly movable in either an upward or downward vertical direction as shown by arrows A4–A5, A6–A7, and A8–A9. For example, by moving roller R7 in the downward direction shown by arrow A7 and moving rollers R6 and R8 upwardly in the direction shown by arrows A4 and A8, the length of the web between rollers R5 and R9 is significantly reduced to the extent that the web may assume the dotted path P1. As another example, by aligning rollers R6, R7 and R8 so that their axes lie on opposite sides of the imaginary plane P1, the length of the web extending between these rollers is determined by the distance between rollers R5 and R9. Alternatively, by moving roller R7 upwardly and rollers R6 and R8 downwardly, the length of the web, i.e. the number of sheets "stored" between rollers R5 and R9, is significantly increased. This assembly 17, typically referred to as a queuing roller assembly may be utilized to delay the delivery of a sheet to the applicator in order that the sheet arrive in synchronism with the bundle thereby providing the stacker with sufficient time to build the desired bundle, dispense the bundle onto the output conveyor, and deliver the bundle to the applicator location. Additional information may also be printed onto the sheet preparatory to its application to the associated bundle which information may be machine readable and/or human readable and may include alphabetic and numeric characters as well as coded information such as, a bar code. The queuing roller assembly may include a greater or smaller number of rollers than is shown in FIG. 1*d*, if desired.

Figure 2A:
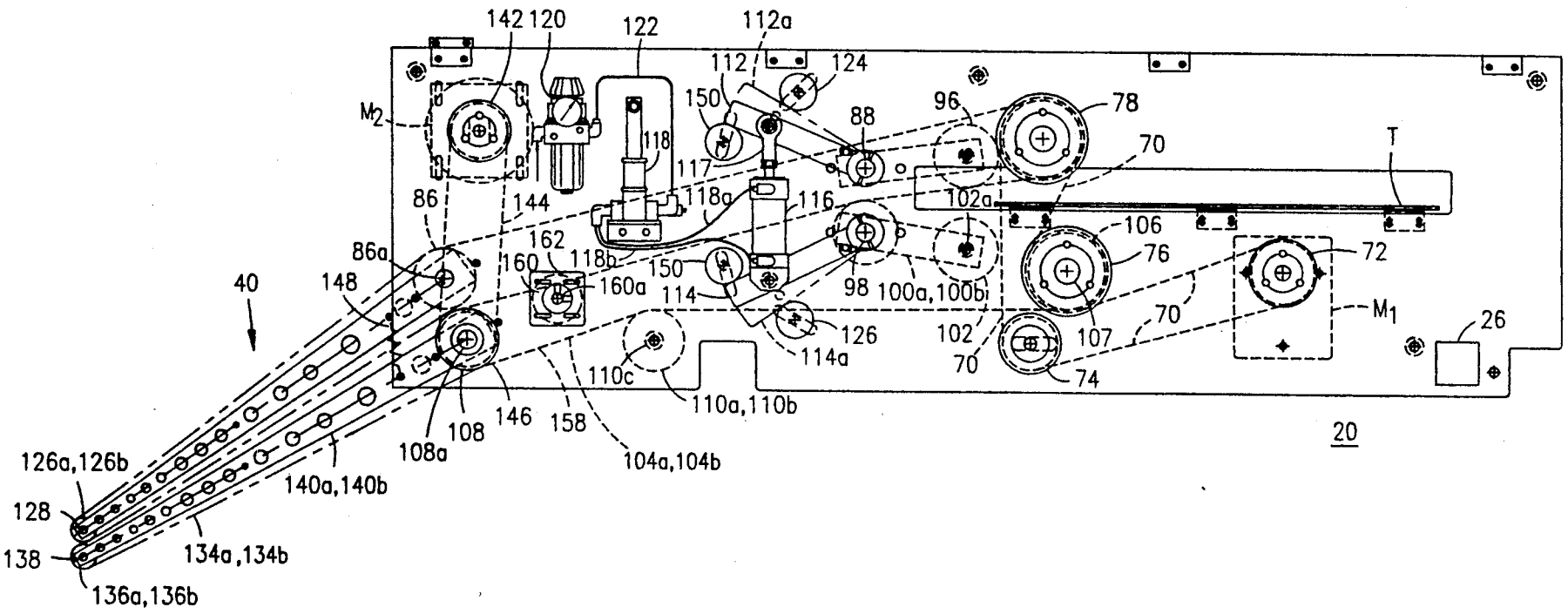
FIG. 2*a* is a detailed elevational of the printer/sheet applicator apparatus of FIGS. 1*a* and 1*b*.
Figure 2B:
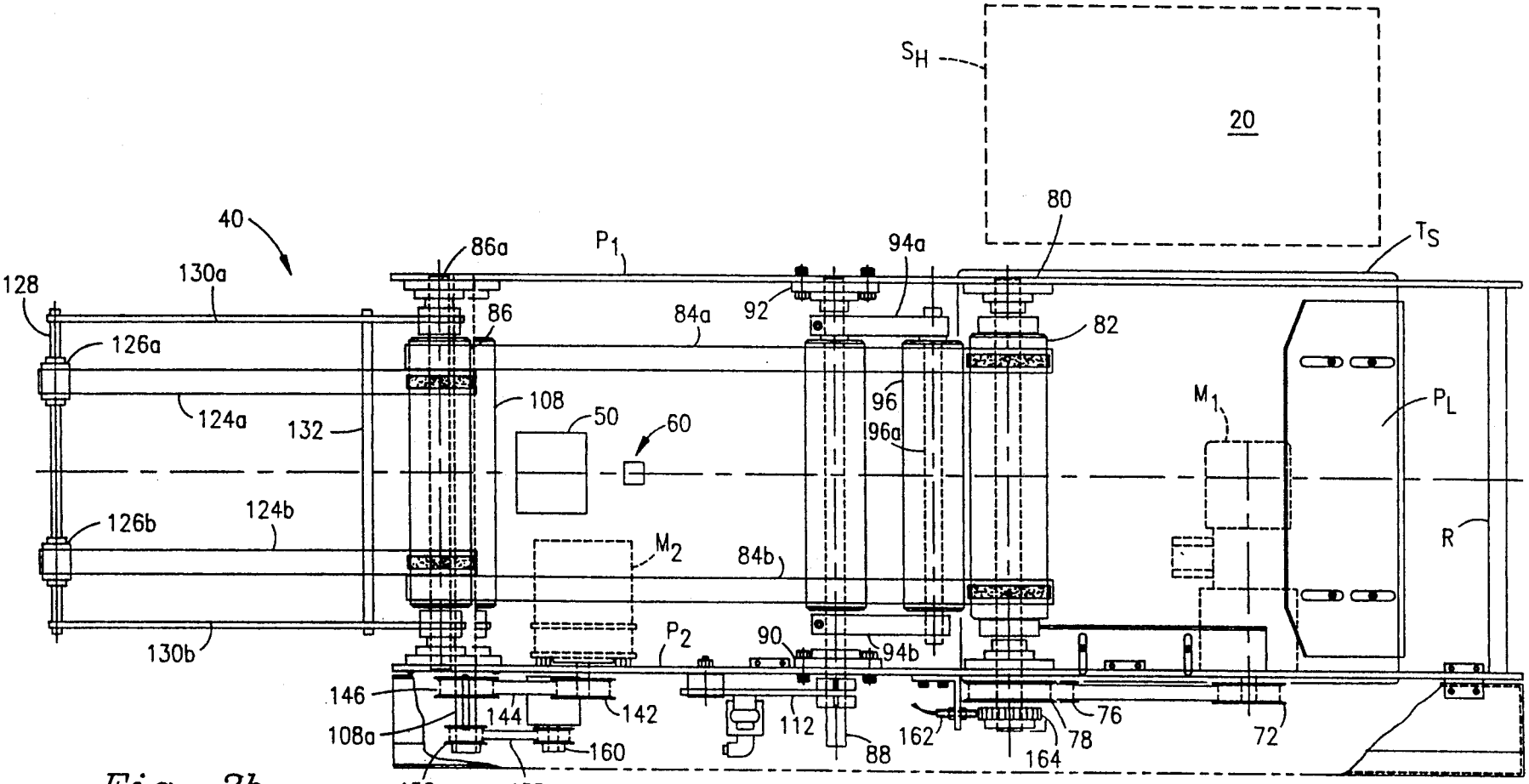
FIG. 2*b* is a plan view of the printer/sheet applicator apparatus of FIG. 2*a*.

FIGS. 2*a* and 2*b* show detailed elevational and top plan views, respectively of the applicator system 20 shown in FIGS. 1*a* and 1*b*. The applicator system 20 is comprised of a belt drive motor M1 which rotates a timing belt pulley 72. A timing belt 70 is entrained about the motor output pulley 72 and pulleys 74, 76 and 78.

The printer/sheet applicator system 20 is provided with a pair of plates for mounting and supporting all of the various components. Plates P1 and P2, for example, support motor M1, all of the rollers, such as, for example, rollers 82 and 106, 96 and 102, and 86 and 108 as well as the other components of the sheet applicator 20. Rod R serves as a spacer rod to maintain the parallelism of plates P1 and P2. A tray surface TS receives each sheet entered into the tray slot T. Plate PL serves as a guide means for guiding the right-hand end of each sheet SH into the tray opening. A slot is provided in each plate P1 and P2 to enable a sheet to be inserted into tray T from either longitudinal side of printer/sheet applicator 20.

Pulley 78 is fixedly mounted upon shaft 80 which also carries a belt roller 82 shown in FIG. 2b. A pair of belts 84a, 84b are entrained about belt drive roller 82 and a driven roller 86 which forms part of the upper arm assembly of the applicator assembly 40.

A shaft 88 is mounted to rotate within bearing 90, 92. A pair of upper levers 94a, 94b are fixedly secured to shaft 88. An upper pinch roller 96 is mounted upon a shaft 96a which is free-wheelingly mounted at the free or right-hand ends of upper lever arms 94a and 94b. Roller 96 is positioned between the upper and lower runs of drive belts 84a, 84b and is further positioned just to the left of roller 82.

A shaft 98 substantially identical to shaft 88 and free-wheelingly mounted in a manner similar to shaft 88, carries a pair of lower lever arms 100a, 100b, only one of said lever arms being visible in FIG. 2a. The free, right-hand ends of lever arms 100a, 100b support shaft 102a of pinch roller 102. Pinch roller is substantially similar in design and function to pinch roller 96 and is positioned just beneath the upper run of a pair of belt assemblies 104a, 104b only one of said belt assemblies being visible in FIG. 2a. Belt assemblies 104a and 104b are aligned with belt assemblies 84a and 84b and are further entrained about a roller 106 mounted on a common shaft 107 which supports pulley 76 and a driven roller 108 which is mounted upon shaft 108a which shaft and roller comprise the upper end of the lower applicator arm subassembly of the applicator assembly 40.

The lower run of belts 104a, 104b are entrained about idler rollers 110a, 110b, only one of which can be seen in FIG. 2a, which idler rollers are mounted to rotate about a common shaft 110c, to maintain the belts 104a, 104b under proper tension.

A pair of drive levers 112, 114 have their right-hand ends respectively securely mounted to the upper and lower shafts 88 and 98. Cylinder 116, having piston rod 117, has its lower end pivotally mounted near the left-hand end of lever 114 and has the free end of its piston rod 117 pivotally coupled near the left-hand end of operating lever 112.

Cylinder 116 is operated by air pressure controlled by valve 118 having, lines 118a, 118b coupled between the outlets of air valve 118 and the inlet ports of cylinder 116. The control valve is preferably a control valve manufactured by MAC. An air regulator 120 is coupled to the air valve 118 by line 122 and regulates the pressure of the air delivered to valve 118. The air regulator is preferably provided with a filter to remove water or moisture from the pressurized air.

When pressurized air is introduced through conduit 118b, cylinder 116 expands causing lever 112 to move to its dotted line position 112a and causing lever 114 to move to its dotted line position 114a. These levers move against rubber cushioning stops 124 and 126 which cushion the abrupt movement of levers 112 and 114. The movement of levers 112 and 114 to their dotted line positions 112a, 114a move rollers 96 and 102 toward one another to form a nip therebetween causing the portions of the belts 84a, 84b and 104a, 104b moving past the nip portions of these rollers to grab the left-hand end of the sheet extending into the V-shaped entrance passageway defined by the lower run of belts 84a, 84b and the upper run of belts 104a, 104b. This "pinching" action abruptly accelerates the sheet pinched in the aforementioned nip causing the sheet to be moved toward the left between the belt assemblies 84a, 84b and 104a, 104b where they are delivered to the inlet end of the adjustable applicator assembly 40.

Each of the rollers 86 and 108 are rotated by the sets of belts 84a, 84b and 104a, 104b entrained therearound. In addition thereto, upper and lower pairs of applicator belts are likewise entrained about these rollers Noting FIG. 2b, a pair of applicator drive belts 124a, 124b are entrained about upper roller 86 and a pair of nose rollers 126a, 126b are free-wheelingly mounted upon a shaft 128 secured at the free or left-hand ends of the upper applicator arms 130a, 130b, which arms are pivotally mounted to swing about shaft 86a. Rod 2 serves as a spacer rod to maintain the parallelism of upper applicator arms 130a and 130b. In a similar fashion, lower roller 108 has belts 104a, 104b entrained therearound and has a second set of belts 134a, 134b entrained about roller 108 and a pair of nose rollers 136a, 136b mounted upon a common shaft 138 supported by lower applicator arms 140a, 140b, only one of which is visible in FIG. 2a.

Lower applicator arms 140a, 140b are likewise pivotally mounted to swing about lower shaft 108a. However, the arms 140a, 140b are securely mounted to shaft 108a in order to rotate therewith.

A position control motor M2 which may, for example, be an AC synchronous motor, is mounted above the applicator assembly and is provided with an output timing belt pulley 142. A timing belt 144 is entrained about timing belt pulley 142 and a pulley 146 mounted upon lower shaft 108a. Motor M2 and its timing belt pulley 142 have been shown positioned to the right of pulley 146 in FIG. 2b for purposes of simplicity.

When it is desired to position the applicator assembly 40 relative to the bundle which is to receive the sheet passing through the applicator assembly, motor M2 is operated to rotate pulley 146, causing the lower applicator arm assembly to rotate either clockwise or counterclockwise about shaft 108a, depending upon the height of the next bundle. The upper applicator arm assembly rests upon the lower applicator arm assembly and follows its movement. In order to further enhance the simultaneous movement between the arms, spring means 148 is coupled to the upper and lower applicator arms on both sides of the upper and lower applicator arm assemblies to cause the upper arm assembly to more closely follow the movement of the lower arm assembly.

After a sheet has entered into the nip between rollers 96 and 102 and has moved sufficiently into the region where the belts 84a, 84b and 104a, 104b firmly engage and move the sheet, cylinder 116 may be operated to the collapsed position moving levers 112 and 114 to their solid line position against rubber bumper cushioning devices 150 and 152 which cushion the abrupt movement of the lever arms 112 and 114. This action causes the rollers 96 and 102 to separate thereby preparing the entrance tray for receipt and "grabbing" of the next sheet delivered thereto.

In order to be assured that the applicator assembly has moved to the proper angular position, a timing belt pulley 156 is mounted upon shaft 108a. A timing belt 158 is entrained about timing belt pulley 156 and a pulley 160 which in turn is coupled to an encoder 162 through a shaft 162*a* rotated by pulley 160. The angular position of shaft 108*a* and hence the angular orientation of the applicator arms may be presented in either analog or digital form for transfer to the microprocessor controlling positioning motor M2, thereby providing positive feedback. The encoder may, for example, be a Model 32-0600-100 manufactured by Dynapar. If desired, any other technique may be employed such as, for example, a stepper motor technique, thereby eliminating the need for a closed loop feedback system. If analog, the encoder may be replaced by a variable resistance unit, for example.

In order to print information of either human readable or machine readable type, the applicator system 20 is provided with a printer 50 which is preferably a non-impact printer capable of printing "on the fly". A suitable printer is Maxum Single Module ink jet printer manufactured by Video Jet. The ink jet printer is capable of printing symbols, alphanumeric characters and other graphic patterns including, for example, a bar code pattern. If desired, any other type of non-impact printer may be employed. The activation of the printer is controlled by the sensing means 60 described hereinabove wherein as the leading edge of a sheet being delivered toward the applicator assembly and hence toward the printer 50 passes between a light source and the reflective surface 60*b*, the breaking of this light pattern by the sheet is detected by the light source/sensor 60*a* causing the microprocessor of control 19 to activate the printer 50 after a predetermined delay equal to the time required for the sheet to move beneath the ink jet(s) of the printer.

Briefly summarizing the operation, as a bundle passes light source/sensor 27*a*, the leading edge breaks the light path between the light source and reflector 27*b* causing the sensor 162 to accumulate distance pulses. As the bundle moves beneath the ultrasonic sensor 26, its height is determined and this information is delivered to the microprocessor-based controller 19 for control purposes. A sheet which may be either unprinted or preprinted is delivered from the stack S and the tractor assemblies T1, T2 to a burster 16 which separates the web into individual sheets and feeds an individual sheet into tray T.

Responsive to the sensing of a bundle by sensors 26 and 27*a*, cylinder 116 is operated by the controller when the bundle reaches the location of the left-hand edge of the sheet in tray T to cause the sheet entered into the V-shaped entrance throat of the upper and lower belt assemblies 84*a*, 84*b* and 104*a*, 104*b* to be pinched between these assemblies by rollers 96 and 102 and abruptly accelerated and advanced between the last-mentioned upper and lower belt assemblies where the sheet is ultimately introduced into the applicator assembly 40.

When the leading edge of the sheet passes sensor 60, printer 50 is activated after a predetermined delay to print the desired information on the sheet.

The bundle height information is utilized by the control 19 to control positioning motor M2 to position the lower applicator arm assembly at the appropriate angle to place the nose rollers 128, 138 immediately above the bundle to receive the sheet passing through the applicator assembly. By the time the sheet passes through the applicator assembly, it has been accelerated to the desired velocity, which velocity is substantially the same as the velocity of the bundle with which the sheet is to be mated. The positioning of the applicator arms is such as to move the applicator arms immediately above the bundle receiving the sheet.

The distance pulses are accumulated by sensor 162 which may preferably be of a magnetic type for sensing the passage of teeth arranged about the periphery of gear 164 mounted upon shaft 80. This distance data is utilized to control the timing of the "pinching" of the sheet.

The initiation of the "pinching" of a sheet within tray T is the function of the velocity and the height of the bundle. For example, when the applicator assembly 40 is rotated counterclockwise to place the sheet upon a bundle of short height, the bundle will reach the applicator location at an earlier time, requiring that the grabbing of the sheet be initiated at an earlier time as compared with delivery of the sheet to a bundle of greater height which necessitates lifting of the applicator arm assembly whereby the distance travelled from the height sensor to the applicator location is greater. These determinations are made by the microprocessor-based controller to control the initiation of the grabbing of a sheet.

As was pointed out hereinabove, a sheet may be preprinted and read by reader 18 (see FIG. 1*b*) to control the operation of a stacker 12. The preprinted sheet is then delivered to its associated stack. If a delay is necessary, the queuing assembly of FIG. 1*d* may be employed. The last-mentioned operation may be performed with or without the use of printer 50 which may either be omitted or may be provided to incorporate further indicia and/or information upon the sheet.

Although the system has been described herein for use in combination with signature bundles or by a stacker, such a sheet may be applied to any other form of bundle, package, carton, or the like so long as the object receiving the sheet is provided with a reasonably flat upper receiving surface. The conveyor utilized to convey such bundles or objects may be of any suitable type such as a roller type, belt type, or even pusher type.

The bundle or object height sensor may be any suitable kind of sensor such as an ultrasonic sensor, a light curtain type of height sensor or may alternatively be a sensor having a sensor arm which physically engages the top of the bundle for determining height.

The control motor M2 may be a synchronous motor, a stepper motor, or any other suitable drive device for accurately positioning the applicator assembly in a positive, high speed manner.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. Apparatus for delivering a sheet to a bundle or the like being conveyed along a surface at a substantially constant velocity in a predetermined direction, comprising:

means for determining the height of the bundle;

receptacle means for receiving a sheet;

movable sheet applicator means having an input end for receiving a sheet and an output end for delivering a received sheet to a bundle passing beneath said applicator means;

means for moving said applicator means responsive to said height sensing means to position the outlet end of said applicator means just above said bundle;

means for accelerating a sheet placed in said receptacle means along a path which is aligned with said predetermined direction and for advancing the sheet to said applicator means outlet end responsive to said sensor means.

2. The apparatus of claim 1 wherein said applicator means includes means for driving a sheet at the output end thereof at a velocity which is substantially equal to the velocity of the bundle receiving said sheet.

3. The apparatus of claim 1 further comprising printer means for printing indicia upon said sheet as it moves between said receptacle means and said applicator means.

4. The apparatus of claim 3 wherein said printer means comprises ink jet printing means.

5. The apparatus of claim 1 further comprising an elongated web of indeterminate length being perforated at spaced intervals in a direction transverse to its length for forming a stack of accordion-pleated sheets;

means for feeding said web toward said receptacle means; and means for separating said web into individual sheets along said perforations preparatory to inserting each sheet into said receptacle means.

6. The apparatus of claim 5 further comprising means for reading indicia on said sheets preparatory to introduction into said receptacle means;

bundle forming means; and means responsive to said indicia for controlling the formation of bundles delivered to said conveyor means by said bundle forming means.

7. The apparatus of claim 1 wherein said bundles comprise a stack of signatures of a predetermined count.

8. The apparatus of claim 1 wherein said bundles comprise a package of generally rectangular parallelepiped shape having a top surface which is substantially flat for receiving an indicia bearing sheet.

9. Apparatus for delivering a sheet to a bundle or the like being conveyed along a surface at a substantially constant velocity, comprising:

means for determining the height of the bundle;

receptacle means for receiving a sheet;

movable sheet applicator means having an input end for receiving a sheet and an output end for delivering a received sheet to a bundle passing beneath said applicator means;

means for moving said applicator means responsive to said height sensing means to position the outlet end of said applicator means above said bundle;

means for accelerating a sheet placed in said receptacle means and for advancing the sheet to said applicator means outlet end responsive to said sensor means;

said applicator means comprising first and second applicator arm assemblies extending between said inlet and outlet ends;

the inlet ends of said applicator arms being respectively swingably mounted about first and second fixed pivot means;

roller means being rotatably supported by said first and second arm assemblies at said inlet and outlet ends;

first and second belt means being respectively entrained about the inlet and outlet roller means of said first and second arm assemblies and being aligned so that the adjacent runs of said first and second belt means engage one another for moving a sheet therebetween; and means for rotating said arm assemblies about their respective pivot means to position the outlet end above the surface of the bundle receiving the sheet dispensed by said applicator means.

10. The apparatus of claim 9 wherein said means for rotating comprises means for rotating one of said first and second arm assemblies.

11. The apparatus of claim 9 further comprising means for biasing the first and second applicator arm assemblies toward one another.

12. The apparatus of claim 9 wherein said rotating means includes motor drive means.

13. The apparatus of claim 12 further comprising a timing belt pulley driven by said motor drive means;

a timing belt pulley coupled to the upper end of said one of said first and second applicator arm assemblies;

a timing belt entrained about said first and second timing belt pulleys for rotating said second timing belt pulley and hence the applicator arm assembly coupled thereto.

14. The apparatus of claim 9 wherein said rotating means comprises an A.,C. synchronous motor.

15. The apparatus of claim 9 further comprising encoder means for sensing the angular position of one of said applicator arm assemblies.

16. The apparatus of claim 15 further comprising control means responsive to said encoder means for controlling said motor drive means.

17. Apparatus for delivering a sheet to a bundle or the like being conveyed along a surface at a substantially constant velocity, comprising:

means for determining the height of the bundle;

receptacle means for receiving a sheet;

movable sheet applicator means having an input end for receiving a sheet and an output end for delivering a received sheet to a bundle passing beneath said applicator means;

means for moving said applicator means responsive to said height sensing means to position the outlet end of said applicator means above said bundle;

means for accelerating a sheet placed in said receptacle means and for advancing the sheet to said applicator means outlet end responsive to said sensor means;

said means for advancing sheets from said receptacle means to said applicator means comprising first and second cooperating belt drive means extending between said applicator means and said receptacle means; said first and second belt drive means comprising first and second belt assemblies each having an adjacent run engaging the other belt assembly for moving sheets from said receptacle means to said applicator assembly;

an input end of said first and second belt drive means adjacent said receptacle means having a V-shaped entrance thereat for receiving one edge of a sheet delivered to said receptacle means; and first and second rotatable pinch roller means arranged adjacent the V-shaped throat portion of said first and second belt drive means for urging associated portions of the first and second belt drive means forming said V-shaped entrance throat into engagement to thereby "grab" the edge of the sheet in the receptacle tray extending into said V-shaped entrance throat for accelerating a sheet and delivering it to the applicator means.

18. The apparatus of claim 17 further comprising control means for moving said pinch rollers between a first position closing said V-shaped entrance throat portion to "grab" a sheet and a second position away from said V-shaped entrance throat in preparation for receipt of a subsequent sheet.

19. The apparatus of claim 18 wherein said control means comprises first and second shafts; first and second lever arms each having a first end adapted about an associated one of said first and second shafts and each having a second end rotatably supporting an associated one of said pinch rollers;

control arms being respectively coupled to said first and second shafts;

drive means for moving said control arms together and apart to respectively open and close said V-shaped entrance throat region.

20. The apparatus of claim 19 wherein said drive means comprises cylinder means.

21. The apparatus of claim 17 wherein said first and second belt assemblies are each entrained about an inlet roller positioned adjacent said receptacle means and one of the inlet rollers of said applicator means.

22. The apparatus of claim 21 further comprising belt drive motor means for rotating the inlet belt drive rollers adjacent said receptacle means.

23. The apparatus of claim 22 further comprising sensor means for generating distance pulses; and means for sensing the passage of a bundle past a predetermined location.

24. The apparatus of claim 23 further comprising means responsive to said bundle sensing means for initiating "pinching" of a sheet in said receptacle means when a predetermined number of distance pulses have been accumulated.

25. A system for forming and marking bundles of signatures and the like comprising:

a stacker for receiving a stream of overlapping signatures and converting said stream of signatures into a bundle of a predetermined count;

a stack of preprinted sheets containing information for presenting bundle size;

means for reading the indicia on each sheet;

means responsive to the indicia observed by said reading mean for controlling said stacker means to form a bundle of a predetermined size;

means for advancing the formed bundle to an applicator location at a substantially constant velocity;

means for determining the height of the formed bundle;

an applicator system comprising:

receptacle means for receiving a sheet;

movable applicator means having an input end for receiving a sheet and an outlet end for delivering a received sheet to a bundle passing beneath said applicator means;

means for moving said applicator means responsive to said height sensing means to position the outlet end of aid applicator means above said bundle; and means for accelerating a sheet placed in said receptacle means and for advancing the sheet to the outlet end of said applicator means.

26. The apparatus of claim 25 wherein said applicator means includes means for driving a sheet from the input end to the output end thereof at a velocity which is substantially equal to the velocity of the bundle receiving said sheet.

27. A system for forming and marking bundles of signatures and the like comprising:

a stacker for receiving a stream of signatures and converting said stream of signatures into a bundle of a predetermined count;

a stack of preprinted sheets containing information for presenting bundle size;

means for reading the indicia on each sheet;

means responsive to the indicia observed by said reading means for controlling said stacker means to form a bundle of a predetermined size;

means for advancing the formed bundle to an applicator location at a substantially constant velocity;

means for determining the height of the formed bundle;

an applicator system comprising:

receptacle means for receiving a sheet;

movable applicator means having an input end for receiving a sheet and an outlet end for delivering a received sheet to a bundle passing beneath said applicator means;

means for moving said applicator means responsive to said height sensing means to position the outlet end of said applicator means above said bundle; and means for accelerating a sheet placed in said receptacle means and for advancing the sheet to the outlet end of said applicator means;

queuing roller means for storing sheets passing between said stack and said receptacle means; and means for controlling said queuing means to regulate the delivery of a sheet to said receptacle means for coordinating arrival of aid sheet with its associated bundle at the applicator station.

28. The apparatus of claim 27 wherein said queuing roller means comprises movable roller means for storing sheets in the region between said stack and said receptacle comprising a rotatably mounted roller including means for linearly moving the roller between a position where the web is unextended to a position displaced therefrom to increase the length of the web extending between said stack and said receptacle means to coordinate delivery of a bundle to a stacking location with the delivery of the sheet to be mated therewith.

29. A method for applying a sheet to the top of a bundle or the like by means of an applicator assembly having an inlet end for receiving sheets and a movable outlet end for delivering sheets therefrom, said method comprising the steps of:

conveying a bundle along a path at a substantially constant velocity toward an applicator location;

measuring the height of the bundle;

moving the outlet end of the applicator assembly so that it is positioned immediately above the top surface of the bundle intended to receive said sheet;

advancing said sheet to a sheet receiving receptacle; and accelerating the sheet within the receptacle toward said applicator assembly and in the direction of said path responsive to the height and position of the bundle intended to receive said sheet.

30. The method of claim 29 further comprising the step of preprinting indicia upon said sheet preparatory to introduction of the sheet into the receptacle means.

31. The method of claim 29 further comprising the step of printing indicia upon said sheet as it moves to the region between said receptacle means and said applicator assembly.

32. The method of claim 31 further comprising the step of printing indicia upon said sheet by the operation of an ink jet printer.

33. The method of claim 29 further comprising supplying an elongated web having perforations at spaced intervals along the length thereof which extend perpendicular to the length of said web to define individual sheets;

separating said web into individual sheets along said perforations; and introducing a separated sheet into said sheet receiving receptacle means.

34. The method of claim 33 further comprising reading preprinted indicia on each sheet preparatory to separation of a sheet;

forming a signature stack of a size determined by the preprinted indicia on said sheet; and conveying said sheet bundle to said applicator station.

35. The method of claim 34 further comprising elongated the web in a controlled manner in the region between said stack and said receptacle means to control the coordination of the sheet dispenser applicator assembly with its associated bundle.

36. A method for applying a sheet to the top of a bundle or the like by means of an applicator assembly having an inlet end for receiving sheets and a movable outlet end for delivering sheets therefrom, said method comprising the steps of:

conveying a bundle along a path at a substantially constant velocity toward an applicator location;

measuring the height of the bundle;

moving the outlet end of the applicator assembly so that it is positioned immediately above the top surface of the bundle intended to receive said sheet;

advancing said sheet to a sheet receiving receptacle; and accelerating the sheet within the receptacle toward said applicator assembly responsive to the height and position of the bundle intended to receive said sheet; and moving the sheet dispensed from the applicator assembly at a speed which is substantially the same as the speed of a bundle receiving said sheet.

37. A method for applying a sheet to the top of a bundle or the like by means of an applicator assembly having an inlet end for receiving sheets and a movable outlet end for delivering sheets therefrom, said method comprising the steps of:

conveying a bundle along a path at a substantially constant velocity toward an applicator location;

measuring the height of the bundle;

moving the outlet end of the applicator assembly so that it is positioned immediately above the top surface of the bundle intended to receive said sheet;

advancing said sheet to a sheet receiving receptacle; and accelerating the sheet within the receptacle toward said applicator assembly responsive to the height and position of the bundle intended to receive said sheet;

providing a tray for receiving a sheet;

detecting the passage of the bundle to receive the sheet in the tray past a predetermined location;

generating distance pulses;

counting said distance pulses when the leading edge of said bundle is detected; and initiating movement of the sheet in the tray to the applicator assembly when a predetermined number of distance pulses have been accumulated.

38. Apparatus for delivering a sheet to a bundle or the like being conveyed along a surface at a substantially constant velocity in a predetermined direction, comprising:

receptacle means for receiving a sheet;

movable sheet applicator means having an input end for receiving a sheet and an output end for delivering a received sheet to a bundle passing beneath said applicator means;

the outlet end of said applicator means being positioned just above the passing bundle;

means for accelerating a sheet placed in said receptacle means along a path which is aligned with said predetermined direction and for advancing the sheet to said applicator means outlet end responsive to said sensor means.

39. A method for applying a sheet to the top of a bundle or the like by means of an applicator assembly having an inlet end for receiving sheets and an outlet end just above the top of the bundle for delivering sheets therefrom, said method comprising the steps of:

conveying a bundle along a path at a substantially constant velocity toward an applicator location;

measuring the height of the bundle;

advancing said sheet to a sheet receiving receptacle; and accelerating the sheet within the receptacle toward said applicator assembly outlet end and in the direction of said path to place the sheet on the moving bundle.

* * * * *

UNITED STATES PATENT AND TRADEMARK OFFICE

CERTIFICATE OF CORRECTION

PATENT NO. : 5,104,105

DATED : April 14, 1992

INVENTOR(S) : Kevin Cote - Jeremy Hyne

It is certified that error appears in the above-identified patent and that said Letters Patent is hereby corrected as shown below:

Column 7, Line 50, after "having" delete - , -

Column 12, Line 26, after "A." delete - , -

Column 12, Line 60, change "thereat" to - throat -

Column 15, Lines 22 and 23, change "elongated" to - elongating -

Signed and Sealed this

Seventh Day of September, 1993

Bruce Lehman

*Attest:*

BRUCE LEHMAN

*Attesting Officer*

*Commissioner of Patents and Trademarks*